US012042001B2

(12) United States Patent
Hartmann

(10) Patent No.: US 12,042,001 B2
(45) Date of Patent: Jul. 23, 2024

(54) SHOE, IN PARTICULAR SPORTS SHOE, AND METHOD FOR PRODUCING SAME

(71) Applicant: PUMA SE, Herzogenaurach (DE)

(72) Inventor: Matthias Hartmann, Forchheim (DE)

(73) Assignee: PUMA SE, Herzogenaurach (DE)

( * ) Notice: Subject to any disclaimer, the term of this patent is extended or adjusted under 35 U.S.C. 154(b) by 296 days.

(21) Appl. No.: 17/415,527

(22) PCT Filed: Dec. 18, 2018

(86) PCT No.: PCT/EP2018/085712
§ 371 (c)(1),
(2) Date: Jun. 17, 2021

(87) PCT Pub. No.: WO2020/125963
PCT Pub. Date: Jun. 25, 2020

(65) Prior Publication Data

US 2022/0053871 A1 Feb. 24, 2022

(51) Int. Cl.
*A43B 1/14* (2006.01)
*A43B 13/04* (2006.01)

(52) U.S. Cl.
CPC ..... *A43B 1/14* (2013.01); *A43B 13/04* (2013.01)

(58) Field of Classification Search
CPC ..... A43B 13/04; A43B 13/42; A43B 13/18; A43B 13/20; A43B 1/14; A43B 13/12
See application file for complete search history.

(56) References Cited

U.S. PATENT DOCUMENTS

| | | | |
|---|---|---|---|
| D15,185 | S | 8/1884 | Brooks |
| 1,433,309 | A | 10/1922 | Stimpson |
| D79,583 | S | 10/1929 | Cutler |
| D84,646 | S | 7/1931 | Murray |

(Continued)

FOREIGN PATENT DOCUMENTS

| | | | |
|---|---|---|---|
| CN | 2875129 | Y | 3/2007 |
| CN | 201005124 | Y | 1/2008 |

(Continued)

OTHER PUBLICATIONS

Machine translation of WO 2017097315—"Shoe, in particular sports shoe" provided by WIPO Patentscope. Accessed May 23, 2023. ( Year: 2023).*

(Continued)

*Primary Examiner* — Clinton T Ostrup
*Assistant Examiner* — Brianna T. Duckworth
(74) *Attorney, Agent, or Firm* — Quarles & Brady LLP

(57) ABSTRACT

The disclosure relates to a shoe having a shoe upper and a sole part connected to the shoe upper, wherein the sole part includes a sole body having a bottom region and a side wall region, wherein the bottom region and the wall region form a receiving chamber which is open at the top, wherein the receiving chamber is filled with a bulk material, wherein the bulk material consists at least partially, of a thermoplastic elastomer and wherein the filled receiving chamber is sealed by a closure body. Further, the closure body is a knitted fabric that forms a lattice structure, wherein the lattice structure has a mesh width ($w_1$, $w_2$) of at least 0.5 mm. The disclosure further relates to a method for producing such a shoe.

13 Claims, 2 Drawing Sheets

(56) References Cited

U.S. PATENT DOCUMENTS

Figure 1:
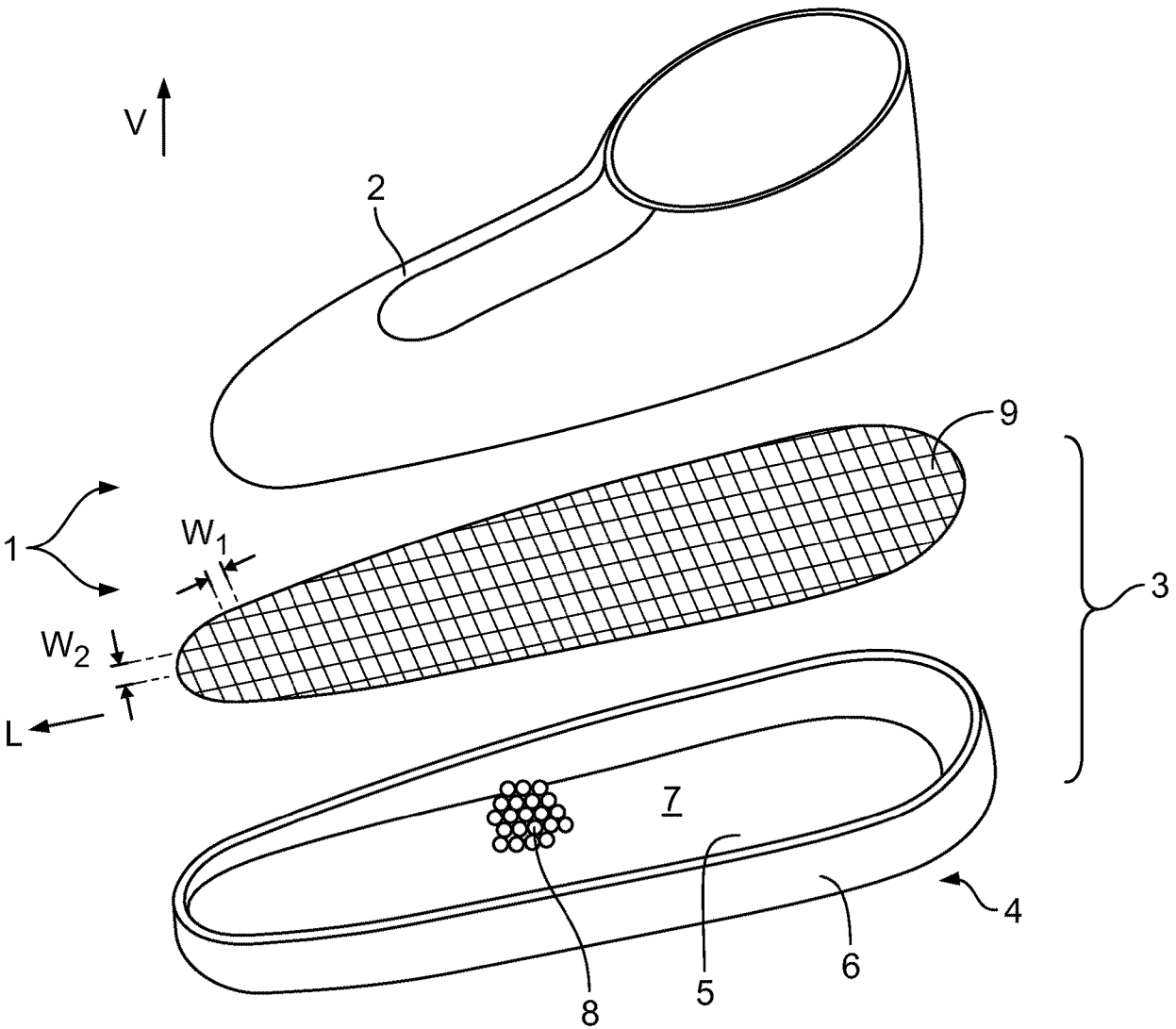

D90,233 S 7/1933 Daniels
D92,670 S 7/1934 Murray
D97,945 S 11/1935 Lutz
2,090,881 A 8/1937 Wilson
D132,621 S 6/1942 Ivan
D161,031 S 11/1950 MacLeod
2,641,004 A 6/1953 Whiting et al.
D171,331 S 1/1954 Haines et al.
2,682,712 A * 7/1954 Owsen ..... A43B 13/20 36/107
3,087,262 A 4/1963 Russell
D196,491 S 10/1963 Papoutsy
D206,222 S 11/1966 Mostile
3,469,576 A 9/1969 Smith
D216,246 S 12/1969 Mistarz
3,573,155 A 3/1971 Mitchell
3,629,051 A 12/1971 Mitchell
3,971,839 A 7/1976 Taylor
D241,484 S 9/1976 Castano
4,089,069 A 5/1978 Vistins
4,112,599 A 9/1978 Krippelz
D254,578 S 4/1980 Finn
D255,171 S 6/1980 Bowers
D255,178 S 6/1980 Fuzita
D255,286 S 6/1980 Fuzita
D256,067 S 7/1980 Hagg et al.
D263,348 S 3/1982 Cohen
D263,518 S 3/1982 Cohen
D265,017 S 6/1982 Vermonet
D265,019 S 6/1982 Vermonet
D265,437 S 7/1982 Vermonet
4,345,387 A 8/1982 Daswick
4,399,620 A 8/1983 Funck
D272,963 S 3/1984 Muller et al.
D274,956 S 8/1984 Saruwatari
4,501,076 A 2/1985 Dodds
4,557,059 A 12/1985 Misevich et al.
D287,902 S 1/1987 Forsyth
4,658,515 A * 4/1987 Oatman ..... A43B 17/14 36/31
D290,182 S 6/1987 Chen
D293,271 S 12/1987 Lussier
D293,275 S 12/1987 Bua
D293,620 S 1/1988 Liggett et al.
D295,917 S 5/1988 Brown et al.
D296,039 S 6/1988 Diaz
D296,149 S 6/1988 Diaz
D296,954 S 8/1988 Tong
D297,682 S 9/1988 Le
D298,483 S 11/1988 Liggett et al.
D298,582 S 11/1988 Caire
D299,581 S 1/1989 Friedenberg
4,843,741 A 7/1989 Yung-Mao
4,845,863 A 7/1989 Yung-Mao
4,858,340 A 8/1989 Pasternak
D304,520 S 11/1989 Clark
D304,521 S 11/1989 Clark
D305,382 S 1/1990 Kiyosawa
D306,793 S 3/1990 Schwartz
D307,971 S 5/1990 Maccano et al.
D308,285 S 6/1990 Serna
D310,293 S 9/1990 Serna et al.
D310,295 S 9/1990 Boucher et al.
D311,989 S 11/1990 Parker et al.
4,970,807 A 11/1990 Anderie et al.
D312,920 S 12/1990 Aveni
D313,113 S 12/1990 Aveni
D319,535 S 9/1991 Hatfield
D320,689 S 10/1991 Smith
D321,589 S 11/1991 Merk et al.
D321,973 S 12/1991 Hatfield
D321,974 S 12/1991 Hatfield
D324,762 S 3/1992 Hatfield
D324,940 S 3/1992 Claveria
5,092,060 A 3/1992 Frachey et al.
D328,815 S 8/1992 Legacki et al.
D329,528 S 9/1992 Hatfield
5,150,490 A 9/1992 Busch et al.
D329,940 S 10/1992 Hatfield
D330,454 S 10/1992 Elliot
5,152,081 A 10/1992 Hallenbeck et al.
D330,627 S 11/1992 Frachey et al.
D330,629 S 11/1992 Bramani
5,222,311 A 6/1993 Lin
D337,650 S 7/1993 Thomas, III et al.
D339,447 S 9/1993 McDonald
D339,448 S 9/1993 Teague
D339,454 S 9/1993 Hatfield
D339,675 S 9/1993 Austin
D339,906 S 10/1993 Frachey et al.
D340,349 S 10/1993 Kilgore et al.
D340,350 S 10/1993 Kilgore et al.
D340,797 S 11/1993 Pallera et al.
D341,700 S 11/1993 Avar
D343,044 S 1/1994 Kilgore et al.
5,313,717 A 5/1994 Allen et al.
5,329,705 A 7/1994 Grim et al.
D350,013 S 8/1994 Gitelman
D350,222 S 9/1994 Hase
5,383,290 A 1/1995 Grim
D356,438 S 3/1995 Opie et al.
D356,885 S 4/1995 Poole, Jr.
D362,956 S 10/1995 Martin et al.
D365,920 S 1/1996 Schneider
D366,955 S 2/1996 Valle
D371,896 S 7/1996 McMullin
D373,013 S 8/1996 Rosetta
5,542,195 A 8/1996 Sessa
D373,896 S 9/1996 Parker
5,575,088 A 11/1996 Allen et al.
5,587,231 A 12/1996 Mereer et al.
5,595,005 A 1/1997 Throneburg et al.
5,607,749 A 3/1997 Strumor
D378,871 S 4/1997 Hatfield
5,617,650 A 4/1997 Grim
5,626,657 A 5/1997 Pearce
D384,794 S 10/1997 Merceron
D386,589 S 11/1997 Cass
D386,590 S 11/1997 Cass
D386,591 S 11/1997 Kuerbis
D387,546 S 12/1997 Pearce
D389,991 S 2/1998 Elliott
D390,349 S 2/1998 Murai et al.
D391,045 S 2/1998 Assous
D391,748 S 3/1998 Koh
D393,299 S 4/1998 Hunt
D395,738 S 7/1998 Hatfield et al.
D396,341 S 7/1998 Lozano et al.
D397,236 S 8/1998 Wilmot
D398,740 S 9/1998 Hewett
D398,748 S 9/1998 Hatfield et al.
D399,041 S 10/1998 Teague
D400,345 S 11/1998 Teaque
D401,397 S 11/1998 Chen
D401,743 S 12/1998 Wunsch
D405,595 S 2/1999 Kayano
D407,892 S 4/1999 Gaudio
5,890,248 A 4/1999 Gee
D411,579 S 6/1999 Dolinsky
5,909,719 A 6/1999 Throneburg et al.
D414,920 S 10/1999 Cahill
D415,607 S 10/1999 Merceron
D415,610 S 10/1999 Cahill
D415,876 S 11/1999 Cahill
D416,669 S 11/1999 Parr et al.
5,996,252 A 12/1999 Cougar
D422,780 S 4/2000 Aguerre
D423,199 S 4/2000 Cahill
6,061,928 A 5/2000 Nichols
D426,053 S 6/2000 Santa
6,076,283 A 6/2000 Boie
D429,874 S 8/2000 Gumbert
D431,346 S 10/2000 Birkenstock
6,127,010 A 10/2000 Franklin

(56) References Cited

U.S. PATENT DOCUMENTS 6,187,837 B1 2/2001 Pearce
D442,767 S 5/2001 Della Valle
D444,620 S 7/2001 Della Valle
6,258,421 B1 7/2001 Potter
D446,002 S 8/2001 Leong et al.
D446,637 S 8/2001 Patterson et al.
D448,544 S 10/2001 Della Valle
6,308,438 B1 10/2001 Throneburg et al.
6,312,782 B1 11/2001 Goldberg et al.
6,314,661 B1 11/2001 Chern
6,341,432 B1 1/2002 Muller
D460,852 S 7/2002 Daudier
6,418,641 B1 7/2002 Schenkel
D461,299 S 8/2002 McClaskie
D461,947 S 8/2002 Merceron
D469,948 S 2/2003 Lin
D470,296 S 2/2003 Masullo
D474,330 S 5/2003 McClaskie
D475,512 S 6/2003 Chen
D479,643 S 9/2003 OShea et al.
D482,851 S 12/2003 McClaskie
D483,932 S 12/2003 Cooper
D485,973 S 2/2004 Adams
D489,880 S 5/2004 McClaskie
D490,223 S 5/2004 McClaskie
D490,233 S 5/2004 Cooper
6,739,074 B2 5/2004 Trommer
D492,101 S 6/2004 Issler
D492,475 S 7/2004 Adams
D494,343 S 8/2004 Morris
6,782,640 B2 8/2004 Westin
D495,861 S 9/2004 Georgiou et al.
D496,149 S 9/2004 Belley et al.
6,817,113 B2 11/2004 Pan
6,848,200 B1 2/2005 Westin
D506,305 S 6/2005 Link
D509,649 S 9/2005 McClaskie
6,948,264 B1 9/2005 Fyden
6,957,504 B2 10/2005 Morris
D511,037 S 11/2005 Della
D511,610 S 11/2005 Della
D512,208 S 12/2005 Kubo et al.
D513,836 S 1/2006 Magro et al.
D515,297 S 2/2006 Acheson
D522,740 S 6/2006 Dojan et al.
7,086,179 B2 8/2006 Dojan et al.
7,086,180 B2 8/2006 Dojan et al.
7,100,310 B2 9/2006 Foxen et al.
D532,599 S 11/2006 Dojan et al.
D532,600 S 11/2006 Dojan et al.
7,141,131 B2 11/2006 Foxen et al.
D534,345 S 1/2007 Dojan et al.
D538,017 S 3/2007 McClaskie
D539,517 S 4/2007 Issler
D540,517 S 4/2007 McClaskie
D547,541 S 7/2007 Schindler et al.
D548,435 S 8/2007 McClaskie
D549,934 S 9/2007 Horne et al.
D551,831 S 10/2007 Romero-Sanchez
D551,833 S 10/2007 Feller
D553,332 S 10/2007 McClaskie
D556,982 S 12/2007 Harper et al.
D560,883 S 2/2008 McClaskie
D561,433 S 2/2008 McClaskie
D564,736 S 3/2008 Belley et al.
D566,934 S 4/2008 Della Valle
D568,035 S 5/2008 McClaskie
D570,581 S 6/2008 Polegato Moretti
D571,085 S 6/2008 McClaskie
D571,987 S 7/2008 Della Valle
D572,440 S 7/2008 Polegato Moretti
D572,441 S 7/2008 Moretti
D572,442 S 7/2008 Polegato Moretti
7,401,420 B2 7/2008 Dojan et al.
D576,380 S 9/2008 Morris
D576,780 S 9/2008 Jolicoeur
7,441,419 B1 10/2008 Dollyhite et al.
D586,090 S 2/2009 Turner et al.
7,484,318 B2 2/2009 Finkelstein
D590,140 S 4/2009 Della Valle
D591,494 S 5/2009 Jolicoeur
D591,938 S 5/2009 Beauger
D595,489 S 7/2009 McClaskie
D596,384 S 7/2009 Andersen et al.
7,555,847 B2 * 7/2009 Kendall ..... A43B 13/12 36/27
7,555,848 B2 7/2009 Aveni et al.
7,556,846 B2 7/2009 Dojan et al.
7,559,107 B2 7/2009 Dojan et al.
7,562,469 B2 7/2009 Dojan
D597,286 S 8/2009 Della Valle et al.
D597,293 S 8/2009 Banik et al.
D599,091 S 9/2009 Della Valle et al.
D599,993 S 9/2009 Issler
D601,333 S 10/2009 McClaskie
D603,151 S 11/2009 Roundhouse
D604,033 S 11/2009 Feldman
D605,837 S 12/2009 Andersen et al.
D607,190 S 1/2010 McClaskie
D608,082 S 1/2010 Lemaster
D608,997 S 2/2010 Loverin
7,662,468 B2 2/2010 Bainbridge
7,665,230 B2 2/2010 Dojan et al.
D610,788 S 3/2010 Della Valle
D611,233 S 3/2010 Della Valle et al.
7,676,955 B2 3/2010 Dojan et al.
7,676,956 B2 3/2010 Dojan et al.
7,703,219 B2 4/2010 Beck
D616,183 S 5/2010 Skaja
D616,640 S 6/2010 Werman
D617,540 S 6/2010 McClaskie
D620,695 S 8/2010 McCarthy et al.
D624,291 S 9/2010 Henderson
D625,499 S 10/2010 Della Valle et al.
7,805,859 B2 10/2010 Finkelstein
D626,321 S 11/2010 Cagner
7,841,108 B2 11/2010 Johnson et al.
D629,185 S 12/2010 Vico et al.
D631,237 S 1/2011 Genuin et al.
D631,646 S 2/2011 Muller
D633,286 S 3/2011 Skaja
D633,287 S 3/2011 Skaja
D636,156 S 4/2011 Della Valle et al.
D636,571 S 4/2011 Avar
D637,803 S 5/2011 Alvear et al.
D639,036 S 6/2011 Delavaldene et al.
D639,535 S 6/2011 Eggert et al.
8,079,159 B1 12/2011 Rosa
D661,073 S 6/2012 Della Valle et al.
D663,516 S 7/2012 Della Valle et al.
D668,845 S 10/2012 Huynh
D668,858 S 10/2012 Shaffer
D671,305 S 11/2012 Escobar
D671,306 S 11/2012 Tzenos
8,302,233 B2 11/2012 Spanks et al.
D674,171 S 1/2013 Bramani et al.
D680,710 S 4/2013 Sundberg
D683,119 S 5/2013 Shyllon
D690,490 S 10/2013 Riddell
D693,553 S 11/2013 McClaskie
D694,501 S 12/2013 Miner
D696,501 S 12/2013 Miner
D696,502 S 12/2013 Miner
D696,503 S 12/2013 Miner
D697,297 S 1/2014 McClaskie
8,657,979 B2 2/2014 Dojan et al.
8,671,591 B2 3/2014 Brown
D702,031 S 4/2014 Nakano
D707,934 S 7/2014 Petrie
D709,680 S 7/2014 Herath
D711,081 S 8/2014 Miner
D713,623 S 9/2014 Lo
D719,327 S 12/2014 Lindner et al.
D721,474 S 1/2015 Miner

(56) References Cited

U.S. PATENT DOCUMENTS

| | | | |
|---|---|---|---|
| D722,220 | S | 2/2015 | Miner |
| D722,425 | S | 2/2015 | Cin |
| 8,961,844 | B2 | 2/2015 | Baghdadi et al. |
| D727,608 | S | 4/2015 | Steven et al. |
| 9,009,991 | B2 | 4/2015 | Sills |
| D730,638 | S | 6/2015 | Christensen et al. |
| D731,763 | S | 6/2015 | Solstad |
| D731,769 | S | 6/2015 | Raysse |
| D734,600 | S | 7/2015 | Gargiulo |
| D734,930 | S | 7/2015 | Bikowski |
| 9,078,493 | B2 | 7/2015 | Bradford |
| D737,548 | S | 9/2015 | Levy |
| D738,078 | S | 9/2015 | Raysse |
| D738,602 | S | 9/2015 | Qin |
| D739,131 | S | 9/2015 | Del Biondi |
| D739,132 | S | 9/2015 | Del Biondi |
| 9,125,454 | B2 | 9/2015 | De Roode et al. |
| D740,003 | S | 10/2015 | Herath |
| D740,004 | S | 10/2015 | Hoellmueller et al. |
| D746,559 | S | 1/2016 | Besanceney et al. |
| D753,381 | S | 4/2016 | Ostapenko |
| D756,085 | S | 5/2016 | Spring |
| D756,620 | S | 5/2016 | Boys |
| D758,056 | S | 6/2016 | Galway et al. |
| D759,358 | S | 6/2016 | Cullen |
| D765,361 | S | 9/2016 | Johnsongriffin |
| D765,362 | S | 9/2016 | Kuerbis |
| D767,263 | S | 9/2016 | Reiser |
| D773,161 | S | 12/2016 | Teteriatnikov |
| D773,790 | S | 12/2016 | Raysse |
| D773,791 | S | 12/2016 | Raysse |
| D776,410 | S | 1/2017 | Galway et al. |
| D781,543 | S | 3/2017 | Raysse |
| D782,793 | S | 4/2017 | Truelsen |
| D783,247 | S | 4/2017 | McMillan |
| D783,974 | S | 4/2017 | McMillan |
| 9,610,746 | B2 | 4/2017 | Wardlaw et al. |
| D790,172 | S | 6/2017 | Hatfield |
| D790,179 | S | 6/2017 | McMillan |
| D790,181 | S | 6/2017 | Parrett |
| 9,682,522 | B2 | 6/2017 | Baghdadi et al. |
| D790,817 | S | 7/2017 | Perkins et al. |
| D791,452 | S | 7/2017 | Dombrow |
| D792,067 | S | 7/2017 | Raysse |
| D793,053 | S | 8/2017 | Cin |
| D793,680 | S | 8/2017 | Lee |
| D793,687 | S | 8/2017 | Cin |
| D793,688 | S | 8/2017 | Avar et al. |
| D794,289 | S | 8/2017 | Kanata |
| D794,300 | S | 8/2017 | Rosen |
| 9,743,705 | B2 | 8/2017 | Thomas et al. |
| D796,170 | S | 9/2017 | Raysse |
| D796,172 | S | 9/2017 | Henrichot et al. |
| D797,417 | S | 9/2017 | Lee et al. |
| D797,418 | S | 9/2017 | Lee et al. |
| D797,420 | S | 9/2017 | Nykreim |
| D798,553 | S | 10/2017 | Lee |
| D799,178 | S | 10/2017 | James |
| D799,183 | S | 10/2017 | Weeks |
| D800,433 | S | 10/2017 | Kuerbis |
| D801,011 | S | 10/2017 | Del Biondi et al. |
| D801,015 | S | 10/2017 | Gibson |
| 9,775,769 | B2 | 10/2017 | Brown et al. |
| 9,781,970 | B2 | 10/2017 | Wardlaw et al. |
| 9,781,974 | B2 | 10/2017 | Reinhardt et al. |
| 9,788,598 | B2 | 10/2017 | Reinhardt et al. |
| 9,788,606 | B2 | 10/2017 | Reinhardt et al. |
| 9,795,186 | B2 | 10/2017 | Reinhardt et al. |
| D801,653 | S | 11/2017 | Small |
| D802,261 | S | 11/2017 | Stillwagon |
| D802,270 | S | 11/2017 | Kirschner |
| 9,820,528 | B2 | 11/2017 | Reinhardt et al. |
| D805,745 | S | 12/2017 | Link |
| 9,849,645 | B2 | 12/2017 | Wardlaw et al. |
| D808,143 | S | 1/2018 | Negri |
| D809,755 | S | 2/2018 | Stavseng et al. |
| D809,756 | S | 2/2018 | Stavseng et al. |
| D809,761 | S | 2/2018 | Parrett |
| D810,407 | S | 2/2018 | DeAlmeida |
| D811,062 | S | 2/2018 | Teague |
| 9,884,947 | B2 | 2/2018 | Prissok et al. |
| D811,714 | S | 3/2018 | Ngene |
| D812,882 | S | 3/2018 | Jenkins et al. |
| D813,508 | S | 3/2018 | Weeks |
| 9,907,365 | B2 | 3/2018 | Downing et al. |
| 9,926,423 | B2 | 3/2018 | Baghdadi |
| D814,752 | S | 4/2018 | Ormsby |
| 9,930,928 | B2 | 4/2018 | Whiteman et al. |
| D816,958 | S | 5/2018 | Cin et al. |
| 9,961,961 | B2 | 5/2018 | Smith |
| 9,968,157 | B2 | 5/2018 | Wardlaw et al. |
| D819,307 | S | 6/2018 | Wurtz |
| D819,310 | S | 6/2018 | Lashmore |
| D819,317 | S | 6/2018 | Wurtz |
| D819,942 | S | 6/2018 | Cin et al. |
| D823,583 | S | 7/2018 | Petrie |
| 10,039,342 | B2 | 8/2018 | Reinhardt et al. |
| D827,258 | S | 9/2018 | Pina |
| D828,686 | S | 9/2018 | Hoellmueller et al. |
| D828,984 | S | 9/2018 | Gibson |
| D831,315 | S | 10/2018 | Mahoney |
| D831,317 | S | 10/2018 | Jenkins et al. |
| 10,098,411 | B2 | 10/2018 | Hoffer et al. |
| 10,098,412 | B2 | 10/2018 | Hoffer et al. |
| D833,129 | S | 11/2018 | Fudalik |
| D834,801 | S | 12/2018 | Ceniceros |
| 10,149,512 | B1 | 12/2018 | Wurtz |
| D836,892 | S | 1/2019 | Jenkins et al. |
| D836,893 | S | 1/2019 | Bischoff et al. |
| D840,135 | S | 2/2019 | Dombrow |
| D840,136 | S | 2/2019 | Herath et al. |
| D840,137 | S | 2/2019 | Herath et al. |
| 10,226,099 | B2 | 3/2019 | Bischoff |
| 10,227,467 | B2 | 3/2019 | Baghdadi |
| D844,952 | S | 4/2019 | Taylor |
| D844,953 | S | 4/2019 | Chen et al. |
| D846,255 | S | 4/2019 | Khalife |
| D846,256 | S | 4/2019 | Khalife |
| 10,259,183 | B2 | 4/2019 | Wardlaw et al. |
| D847,475 | S | 5/2019 | Khalife |
| D847,480 | S | 5/2019 | Khalife |
| D848,715 | S | 5/2019 | Holmes |
| D849,382 | S | 5/2019 | Jenkins et al. |
| 10,279,581 | B2 | 5/2019 | Ashcroft et al. |
| D850,083 | S | 6/2019 | Jenkins et al. |
| D850,766 | S | 6/2019 | Girard et al. |
| D851,889 | S | 6/2019 | Dobson et al. |
| D852,475 | S | 7/2019 | Hoellmueller |
| D852,476 | S | 7/2019 | Hartmann |
| D853,094 | S | 7/2019 | Young |
| D853,099 | S | 7/2019 | Parrett |
| D853,690 | S | 7/2019 | Taylor |
| D853,691 | S | 7/2019 | Coonrod et al. |
| D853,699 | S | 7/2019 | Coonrod et al. |
| D854,288 | S | 7/2019 | Raasch |
| D854,294 | S | 7/2019 | McMillan |
| D854,296 | S | 7/2019 | Hardman |
| D854,297 | S | 7/2019 | Hardman |
| D854,298 | S | 7/2019 | Nethongkome |
| D855,297 | S | 8/2019 | Motoki |
| D855,953 | S | 8/2019 | Girard et al. |
| D857,360 | S | 8/2019 | Hardy |
| D858,051 | S | 9/2019 | Mace |
| D858,960 | S | 9/2019 | Mace |
| D858,961 | S | 9/2019 | Mace |
| D859,801 | S | 9/2019 | Jenkins et al. |
| D860,616 | S | 9/2019 | Cran |
| D856,650 | S | 10/2019 | Schultze |
| D862,047 | S | 10/2019 | Patillon et al. |
| D862,051 | S | 10/2019 | Goussev et al. |
| D864,540 | S | 10/2019 | Rosen |
| D866,137 | S | 11/2019 | Kanata |
| D866,144 | S | 11/2019 | Kanata |
| D867,734 | S | 11/2019 | Dieudonne |

(56) References Cited

U.S. PATENT DOCUMENTS

D867,737 S 11/2019 Kanata
D868,440 S 12/2019 Dieudonne
D869,833 S 12/2019 Hartmann
D870,433 S 12/2019 Hartmann
D871,731 S 1/2020 Behr
D871,732 S 1/2020 Behr
D872,436 S 1/2020 Matthews
D872,437 S 1/2020 Matthews
D872,438 S 1/2020 Matthews
D873,545 S 1/2020 Hartmann
D874,098 S 2/2020 Hartmann
D874,099 S 2/2020 Hartmann
D874,107 S 2/2020 Girard
D874,801 S 2/2020 Hartmann
D875,358 S 2/2020 Vella
D875,360 S 2/2020 Vella
D875,361 S 2/2020 Girard
D875,362 S 2/2020 Girard
D875,383 S 2/2020 Mace
D876,052 S 2/2020 Hartmann
D876,055 S 2/2020 Hartmann
D876,063 S 2/2020 Matthews
D876,069 S 2/2020 Mace
D876,757 S 3/2020 Hartmann
D876,776 S 3/2020 Matthews
D876,791 S 3/2020 Gridley
D877,465 S 3/2020 Hartmann
D877,466 S 3/2020 Hartmann
D877,468 S 3/2020 Reyes
D878,015 S 3/2020 Hartmann
D878,021 S 3/2020 Mace
D878,025 S 3/2020 Hartmann
D879,424 S 3/2020 Hartmann et al.
D879,430 S 3/2020 Gerig
D880,126 S 4/2020 Powers
D880,822 S 4/2020 Hartmann et al.
D880,825 S 4/2020 Garcia
D882,219 S 4/2020 Hartmann
D882,222 S 4/2020 Garcia
D882,227 S 4/2020 Braun
D883,620 S 5/2020 Gridley
D883,621 S 5/2020 Garcia
D885,719 S 6/2020 Garcia
D885,721 S 6/2020 Williams
D885,722 S 6/2020 Le
D885,724 S 6/2020 Girard et al.
D887,112 S 6/2020 Mace
D887,113 S 6/2020 Girard et al.
D887,686 S 6/2020 Sogorb
D887,691 S 6/2020 Vella
D887,693 S 6/2020 Hartmann et al.
D889,788 S 7/2020 Yoshinaga et al.
D889,789 S 7/2020 Jenkins et al.
D889,815 S 7/2020 Mace
D890,485 S 7/2020 Perrault et al.
D890,488 S 7/2020 Vella
D890,496 S 7/2020 Le
D890,497 S 7/2020 Le
D891,051 S 7/2020 Smith et al.
D891,053 S 7/2020 Dance
D891,054 S 7/2020 Dance
D891,738 S 8/2020 Garcia
D892,480 S 8/2020 Mace
D893,837 S 8/2020 Ni et al.
D893,838 S 8/2020 Le
D893,843 S 8/2020 Hartmann
D893,855 S 8/2020 Gridley
D894,572 S 9/2020 Cali
D896,485 S 9/2020 Williams
D902,539 S 11/2020 Mace
D903,252 S 12/2020 Vella
D905,942 S 12/2020 Dance
D906,648 S 1/2021 Hoellmueller
D906,653 S 1/2021 Le
D907,344 S 1/2021 Hartmann
D907,903 S 1/2021 Garcia
D909,723 S 2/2021 Girard et al.
D909,739 S 2/2021 Toelle
D910,290 S 2/2021 Girard et al.
D910,291 S 2/2021 Zeng
D911,682 S 3/2021 Girard et al.
D911,683 S 3/2021 Girard et al.
D913,647 S 3/2021 Garcia
D913,654 S 3/2021 Dance
D916,444 S 4/2021 Callow et al.
D916,445 S 4/2021 Vella
D920,644 S 6/2021 Chipman
D920,645 S 6/2021 Chipman
D921,342 S 6/2021 Girard et al.
D922,042 S 6/2021 Girard et al.
D922,743 S 6/2021 Hardman
D928,479 S 8/2021 Le et al.
D930,961 S 9/2021 Le
D943,895 S 2/2022 Coonrod et al.
D944,504 S 3/2022 Dowling
D948,846 S 4/2022 Mace
D953,709 S 6/2022 Girard
D953,710 S 6/2022 Girard
D960,541 S 8/2022 Girard
2003/0046831 A1 3/2003 Westin
2003/0115691 A1 6/2003 Mukherjee et al.
2003/0208925 A1 11/2003 Pan
2004/0032042 A1 2/2004 Chi
2004/0148805 A1 8/2004 Morris
2004/0163280 A1* 8/2004 Morris ..... A43B 9/00 36/28
2005/0022424 A1 2/2005 Held
2005/0110183 A1 5/2005 Buchel
2005/0132608 A1* 6/2005 Dojan ..... A43B 13/20 36/28
2005/0188562 A1 9/2005 Clarke et al.
2005/0193592 A1 9/2005 Dua et al.
2005/0229431 A1 10/2005 Gerlin
2006/0010717 A1 1/2006 Finkelstein
2006/0021252 A1 2/2006 Throneburg et al.
2006/0026863 A1 2/2006 Liu
2006/0130363 A1* 6/2006 Hottinger ..... A43B 13/125 36/11.5
2006/0175036 A1 8/2006 Guerrero
2006/0277788 A1 12/2006 Fujii
2007/0011914 A1 1/2007 Keen et al.
2007/0094892 A1 5/2007 Craig et al.
2008/0005936 A1 1/2008 Chiu
2008/0066341 A1 3/2008 Hottinger
2008/0110053 A1 5/2008 Dominquez et al.
2008/0148599 A1 6/2008 Collins
2008/0277837 A1 11/2008 Liu et al.
2008/0307679 A1 12/2008 Chiang et al.
2009/0013558 A1 1/2009 Hazenberg et al.
2009/0313853 A1 12/2009 Tadin
2010/0005684 A1 1/2010 Nishiwaki et al.
2010/0242309 A1 9/2010 McCann
2011/0016747 A1 1/2011 Bitton
2011/0099845 A1 5/2011 Miller
2011/0107622 A1 5/2011 Schwirian
2011/0131832 A1 6/2011 Brandt
2011/0232135 A1 9/2011 Dean et al.
2011/0252670 A1 10/2011 Smith
2012/0005920 A1 1/2012 Alvear et al.
2012/0023784 A1 2/2012 Goldston et al.
2012/0186107 A1 7/2012 Crary et al.
2012/0204451 A1 8/2012 De Roode et al.
2012/0210602 A1 8/2012 Brown
2013/0126075 A1 5/2013 Jiang
2013/0145653 A1* 6/2013 Bradford ..... A43B 13/42 36/103
2013/0227858 A1 9/2013 James
2013/0247415 A1 9/2013 Kohatsu
2013/0291409 A1 11/2013 Reinhardt et al.
2014/0068879 A1 3/2014 Sussmann
2014/0137434 A1 5/2014 Craig
2014/0150292 A1 6/2014 Podhajny et al.
2014/0151918 A1 6/2014 Hartmann
2014/0223673 A1 8/2014 Wardlaw et al.

(56) References Cited

U.S. PATENT DOCUMENTS

| | | | | |
|---|---|---|---|---|
| 2014/0223776 | A1 | 8/2014 | Wardlaw et al. | |
| 2014/0223777 | A1 | 8/2014 | Whiteman et al. | |
| 2014/0243442 | A1 | 8/2014 | Coles et al. | |
| 2014/0310986 | A1 | 10/2014 | Tamm et al. | |
| 2015/0096203 | A1 | 4/2015 | Brown et al. | |
| 2015/0196085 | A1 | 7/2015 | Westmoreland et al. | |
| 2015/0250256 | A1 | 9/2015 | Podhajny | |
| 2015/0257481 | A1 | 9/2015 | Campos et al. | |
| 2015/0342296 | A1 | 12/2015 | Skaja et al. | |
| 2015/0344661 | A1 | 12/2015 | Spies et al. | |
| 2015/0351493 | A1 | 12/2015 | Ashcroft et al. | |
| 2016/0007675 | A1 | 1/2016 | Bier et al. | |
| 2016/0007676 | A1 | 1/2016 | Leimer et al. | |
| 2016/0037859 | A1 | 2/2016 | Smith et al. | |
| 2016/0044992 | A1 | 2/2016 | Reinhardt et al. | |
| 2016/0128426 | A1 | 5/2016 | Reinhardt et al. | |
| 2016/0150855 | A1 | 6/2016 | Peyton | |
| 2016/0227876 | A1 | 8/2016 | Le et al. | |
| 2016/0278481 | A1 | 9/2016 | Le et al. | |
| 2016/0295955 | A1 | 10/2016 | Wardlaw et al. | |
| 2016/0302527 | A1 | 10/2016 | Meir | |
| 2016/0311993 | A1 | 10/2016 | Zhang et al. | |
| 2016/0338446 | A1* | 11/2016 | Merlo | A43B 13/04 |
| 2016/0374428 | A1 | 12/2016 | Kormann et al. | |
| 2017/0006958 | A1 | 1/2017 | Jeong | |
| 2017/0020228 | A1 | 1/2017 | Scofield et al. | |
| 2017/0253710 | A1 | 9/2017 | Smith et al. | |
| 2017/0259474 | A1 | 9/2017 | Holmes et al. | |
| 2017/0303635 | A1 | 10/2017 | Kazarian | |
| 2017/0341325 | A1 | 11/2017 | Le et al. | |
| 2017/0341326 | A1 | 11/2017 | Holmes et al. | |
| 2017/0341327 | A1 | 11/2017 | Le et al. | |
| 2017/0354568 | A1 | 12/2017 | Brown et al. | |
| 2018/0000197 | A1 | 1/2018 | Wardlaw et al. | |
| 2018/0035755 | A1 | 2/2018 | Reinhardt et al. | |
| 2018/0055137 | A1 | 3/2018 | Fraser et al. | |
| 2018/0055144 | A1 | 3/2018 | Bischoff | |
| 2018/0064210 | A1 | 3/2018 | Turner et al. | |
| 2018/0077997 | A1 | 3/2018 | Hoffer et al. | |
| 2018/0092432 | A1 | 4/2018 | Hoffer et al. | |
| 2018/0100049 | A1 | 4/2018 | Prissok et al. | |
| 2018/0103719 | A1 | 4/2018 | Chen | |
| 2018/0103725 | A1 | 4/2018 | Chen | |
| 2018/0132487 | A1 | 5/2018 | Kormann et al. | |
| 2018/0153252 | A1 | 6/2018 | Archer et al. | |
| 2018/0153264 | A1 | 6/2018 | Amos et al. | |
| 2018/0154598 | A1 | 6/2018 | Kurtz et al. | |
| 2018/0168281 | A1 | 6/2018 | Case et al. | |
| 2018/0199667 | A1 | 7/2018 | Wang | |
| 2018/0206591 | A1 | 7/2018 | Whiteman et al. | |
| 2018/0206599 | A1 | 7/2018 | Amos et al. | |
| 2018/0213886 | A1 | 8/2018 | Connell et al. | |
| 2018/0235310 | A1 | 8/2018 | Wardlaw et al. | |
| 2018/0271211 | A1 | 9/2018 | Perrault et al. | |
| 2018/0271213 | A1 | 9/2018 | Perrault et al. | |
| 2018/0289108 | A1 | 10/2018 | Hoffer et al. | |
| 2018/0296821 | A1 | 10/2018 | Ho | |
| 2018/0303197 | A1 | 10/2018 | Chen et al. | |
| 2018/0303198 | A1 | 10/2018 | Reinhardt et al. | |
| 2018/0317591 | A1 | 11/2018 | Hollinger | |
| 2018/0317600 | A1 | 11/2018 | Campos et al. | |
| 2018/0317603 | A1 | 11/2018 | Gronlykke | |
| 2018/0338573 | A1 | 11/2018 | Cross et al. | |
| 2018/0338575 | A1 | 11/2018 | Elder et al. | |
| 2018/0352900 | A1 | 12/2018 | Hartmann et al. | |
| 2019/0029363 | A1 | 3/2019 | Lucca | |
| 2019/0069633 | A1 | 3/2019 | Lucca | |
| 2019/0069634 | A1 | 3/2019 | Lucca | |
| 2019/0126580 | A1 | 5/2019 | Paulson et al. | |
| 2019/0133251 | A1 | 5/2019 | Hartmann et al. | |
| 2019/0150564 | A1 | 5/2019 | Bischoff | |
| 2019/0216167 | A1 | 7/2019 | Hoffer et al. | |
| 2019/0216168 | A1 | 7/2019 | Hoffer et al. | |
| 2019/0223539 | A1 | 7/2019 | Hoffer et al. | |
| 2019/0223550 | A1 | 7/2019 | Levy | |
| 2019/0223551 | A1 | 7/2019 | Hoffer et al. | |
| 2019/0269200 | A1 | 9/2019 | Tseng et al. | |
| 2019/0283394 | A1 | 9/2019 | Ashcroft et al. | |
| 2019/0343225 | A1* | 11/2019 | Reddy | A43B 13/125 |
| 2020/0008518 | A1 | 1/2020 | Souyri et al. | |
| 2020/0046068 | A1* | 2/2020 | Choi | A43B 1/04 |
| 2020/0060383 | A1 | 2/2020 | Le | |
| 2020/0077741 | A1 | 3/2020 | Hurd | |
| 2020/0093221 | A1 | 3/2020 | Caldwell et al. | |
| 2020/0107608 | A1 | 4/2020 | Uzzeni | |
| 2020/0170342 | A1 | 6/2020 | Uzzeni | |
| 2020/0375307 | A1* | 12/2020 | Hurd | A43B 13/125 |
| 2021/0022443 | A1 | 1/2021 | Hoffer et al. | |

FOREIGN PATENT DOCUMENTS

| | | | |
|---|---|---|---|
| CN | 101484033 | A | 7/2009 |
| CN | 201767147 | U | 3/2011 |
| CN | 102366199 | A | 3/2012 |
| CN | 103298362 | A | 9/2013 |
| CN | 103717658 | A | 4/2014 |
| CN | 103976505 | A | 8/2014 |
| CN | 104470393 | A | 3/2015 |
| CN | 105982390 | A | 10/2016 |
| CN | 107048590 | A | 8/2017 |
| CN | 107849286 | A | 3/2018 |
| CN | 207186082 | U | 4/2018 |
| CN | 108366644 | A | 8/2018 |
| DE | 102010046278 | A1 | 2/2011 |
| DE | 102011108744 | A1 | 1/2013 |
| DM | 102274-006 | | 7/2018 |
| DM | 103418-013 | | 10/2018 |
| EM | 001286116-0005 | | 7/2011 |
| EM | 002219956-0024 | | 4/2013 |
| EM | 002772764-0015 | | 9/2015 |
| EM | 003039619-0034 | | 3/2016 |
| EM | 003330174-0003 | | 3/2016 |
| EM | 003165984-0005 | | 6/2016 |
| EM | 003315555-0001 | | 7/2016 |
| EM | 003316389-0001 | | 7/2016 |
| EM | 003344076-0002 | | 8/2016 |
| EM | 003362672-0001 | | 9/2016 |
| EM | 003522580-0029 | | 12/2016 |
| EM | 003649060-0005 | | 1/2017 |
| EM | 003649540-0001 | | 1/2017 |
| EM | 003718311-0019 | | 1/2017 |
| EM | 003761089-0028 | | 2/2017 |
| EM | 003761113-0025 | | 2/2017 |
| EM | 004352755-0004 | | 9/2017 |
| EM | 004363935-0008 | | 9/2017 |
| EM | 004366326-0001 | | 9/2017 |
| EM | 004386571-0002 | | 10/2017 |
| EM | 004543882-0008 | | 12/2017 |
| EM | 004675411-0006 | | 1/2018 |
| EM | 004812501-0004 | | 3/2018 |
| EM | 005841939-0004 | | 3/2018 |
| EM | 005191004-0010 | | 4/2018 |
| EM | 005243227-0002 | | 4/2018 |
| EM | 005260023-0003 | | 5/2018 |
| EM | 005278413-0002 | | 5/2018 |
| EM | 005320371-0002 | | 6/2018 |
| EM | 005612025-0001 | | 8/2018 |
| EM | 006335345-0003 | | 3/2019 |
| EP | 0383685 | A1 | 8/1990 |
| EP | 1738889 | A1 | 1/2007 |
| EP | 1979401 | B1 | 9/2010 |
| EP | 2786670 | A1 | 10/2014 |
| EP | 2984956 | A1 | 2/2016 |
| EP | 3027377 | A1 | 6/2016 |
| EP | 3041892 | A1 | 7/2016 |
| EP | 2649896 | B1 | 10/2016 |
| EP | 3078287 | A1 | 10/2016 |
| EP | 3114959 | A1 | 1/2017 |
| EP | 3186306 | A1 | 7/2017 |
| EP | 2467037 | B1 | 10/2017 |
| EP | 2872309 | B1 | 11/2017 |
| EP | 3289907 | A1 | 3/2018 |
| EP | 3308663 | A1 | 4/2018 |
| EP | 3338581 | A1 | 6/2018 |

(56) References Cited

FOREIGN PATENT DOCUMENTS

| | | | |
|---|---|---|---|
| EP | 3352607 | A1 | 8/2018 |
| EP | 3352608 | A1 | 8/2018 |
| EP | 3352610 | A1 | 8/2018 |
| EP | 3352611 | A1 | 8/2018 |
| EP | 3352612 | A1 | 8/2018 |
| EP | 3352615 | A1 | 8/2018 |
| EP | 3338984 | A3 | 9/2018 |
| EP | 3248770 | B1 | 5/2019 |
| EP | 3476237 | A1 | 5/2019 |
| EP | 3386334 | B1 | 7/2019 |
| FR | 2709047 | A1 | 2/1995 |
| JP | 10248610 | A | 9/1998 |
| JP | 1146806 | | 2/1999 |
| JP | 2000316606 | A | 11/2000 |
| JP | 2002535468 | A | 10/2002 |
| JP | 2004161987 | A | 6/2004 |
| JP | 2007185353 | A | 7/2007 |
| JP | 2011177206 | A | 9/2011 |
| JP | 2013536707 | A | 9/2013 |
| JP | 2014151210 | A | 8/2014 |
| JP | 2015077475 | A | 4/2015 |
| JP | 2015513354 | A | 5/2015 |
| JP | 2018535767 | A | 12/2018 |
| KR | 1020140025298 | A | 3/2014 |
| KR | 101550222 | B1 | 9/2015 |
| WO | 9929203 | A1 | 6/1999 |
| WO | 0078171 | A1 | 12/2000 |
| WO | 0101806 | A1 | 1/2001 |
| WO | 2005066250 | A1 | 7/2005 |
| WO | 2006066256 | A2 | 6/2006 |
| WO | 2007024523 | A1 | 3/2007 |
| WO | 2007082838 | A1 | 7/2007 |
| WO | 20070139832 | A2 | 12/2007 |
| WO | 2008003375 | A1 | 1/2008 |
| WO | 2010010010 | A1 | 1/2010 |
| WO | 2016030026 | A1 | 3/2016 |
| WO | 2016030333 | A1 | 3/2016 |
| WO | 2017053650 | A1 | 3/2017 |
| WO | 2017053654 | A1 | 3/2017 |
| WO | 2017053658 | A1 | 3/2017 |
| WO | 2017053665 | A1 | 3/2017 |
| WO | 2017053669 | A1 | 3/2017 |
| WO | 2017053674 | A1 | 3/2017 |
| WO | 2017097315 | A1 | 6/2017 |
| WO | 2018099833 | A1 | 6/2018 |
| WO | 2018103811 | A1 | 6/2018 |
| WO | 2018169535 | A1 | 9/2018 |
| WO | 2018169537 | A1 | 9/2018 |
| WO | 2018175734 | A1 | 9/2018 |
| WO | 2019029781 | A1 | 2/2019 |
| WO | 2019073607 | A1 | 4/2019 |
| WO | 2019101339 | A1 | 5/2019 |
| WO | 2019150492 | A1 | 8/2019 |

OTHER PUBLICATIONS

Threadden, "The Difference Between Knits and Wovens", Jun. 15, 2018, https://threadden.com/sewing-tips/the-difference-between-knits-wovens/ (Year: 2018).*

Wikipedia, "Leno Weave", Accessed May 25, 2023, https://en.wikipedia.org/wiki/Leno_weave (Year: 2023).*

Sewport, "What is Spandex Fabric: Properties, How its Made and Where", May 23, 2023, https://www.sewport.com/fabrics-directory/spandex-fabric (Year: 2023).*

International Search Report (with English translation) and Written Opinion issued in International Application No. PCT/EP2015/002456, dated Oct. 25, 2016, 17 pages.

Adidas' FutureCraft Loop Sneaker Talks a Big Recycling Game, Gizmodo, Published on Apr. 17, 2019, 10 pages, [online], [site visited Sep. 5, 2019]. <URL: https://gizmodo.com/adidas-futurecraft-loop-sneaker-talks-a-big-recycling-1834086618> (Year: 2019).

Ben Felderstein "Puma to Debut New Jamming Cushion on Nov. 9th" © 2007-2019 Sneaker News Inc, Nov. 7, 2017, 7 pages, [online], [site visited Jul. 23, 2019] <URL: https://sneakernews.com/2017/11/07/puma-jamming-cushion-release-info/> (Year 2017).

Cruise Down the Streets in the Distinctive Puma Hybrid Runner, RunnersWorld.com, by Amanda Furrer, Jul. 2, 2018, 11 pages, [online], [site visited Jul. 26, 2019]. <URL: https://www.runnersworld.com/gear/a21987976/puma-hybrid-runner-shoe-review/> (Year: 2018).

Did Nike Not Get the Memo on Plastic Beads?, Gizmodo, Published on Jul. 25, 2019, 7 pages, [online], [site visited Sep. 5, 2019]. <URL: https://earther.gizmodo.com/did-nike-not-get-the-memo-on-plastic-beads-1836694806> (Year: 2019).

Puma Jamming NRGY Shoe Unboxing /Review+ on Feet, YouTube.com, Published on Dec. 21, 2017, 1 page, [online]. [site visited Jul. 26, 2019]. <URL: https://www.youtube.com/watch?v=rpCmRWeDbj8> (Year: 2017).

The beads that move with you, Puma Catch up, Published on Nov. 9, 2017, 6 pages, [online], [site visited Sep. 5, 2019]. <URL: https://www.puma-catchup.com/jamming-pumas-new-sole-technology-ultimate-comfort/> (Year: 2017).

The Puma Jamming Introduces New Cushioning Technology, Sneakers-Magazine.com, Posted Nov. 9, 2017, 3 pages, [online], [site visited Jul. 26, 2019]. <URL: https://sneakers-magazine.com/puma-jamming-nrgy-beads/> (Year: 2017).

Adidas Mega Soft Cell, BX Sports's Weblog, Published on Aug. 6, 2010, [online], [site visited Jul. 29, 2019]. <URL: https://bx97.wordpress.com/2010/08/06/adidas-mega-soft-cell-2/> (Year: 2010).

Small beads for long distances, BASF, Published on Aug. 13, 2013, [online], [site visited Aug. 1, 2019]. <URL: https://www.basf.com/global/documents/en/news-and-media/science-around-us/small-beads-for-long-distances/BASF_Science_around_us_Infinergy.pdf> (Year: 2013).

Zaleski, Andrew, "Who's Winning the 3D-Printed Shoe Race?" Fortune.com; Published on Dec. 15, 2015 [online] [site visited Aug. 6, 2019] <URL: https://fortune.com/2015/12/15/3d-printed-shoe-race/> (Year 2015), pp. 1-12.

Schlemmer, Zack, "New Balance Trailbuster Fresh Foam Drops in Two Monochrome Colorways," Sneaker News; Published on Apr. 22, 2017 [online] [site visited Aug. 6, 2019] <URL: https://sneakernews.com/2017/04/22/new-balance-trailbuster-fresh-foam-drops-black-white/> (Year 2017), pp. 1-8.

First Office Action from corresponding Japanese Patent Application No. 2020-546945 dated Nov. 2, 2021 (8 pages) (English translation included).

Office Action from corresponding Korean Application No. 10-2018-7016199 dated Dec. 22, 2021 (English translation included) (13 pages).

Office Action from corresponding Indian Application No. 201817021054 dated Nov. 10, 2021 (English translation Included) (5 pages).

First Office Action from corresponding Chinese Patent Application No. 201880100006.2 dated Jan. 7, 2022 (16 bages) (English translation included).

Hybrid NX Ozone Men's Running Shoes, Us.Puma.com, [online], [site visited Sep. 8, 2020]. <URL: https://us.puma.com/en/us/pd/hybrid-nx-ozone-mens-running-shoes/193384.html?dwvar 193384_color=06> (Year: 2020).

Hybrid Astro Men's Running Shoes, Us.Puma.com, [online], [site visited Sep. 8, 2020]. <URL: https://us.puma.com/en/us/pd/hybrid-astro-mens-running-shoes/192799.html?dwvar 192799_color=07> (Year: 2020).

Second Office Action from corresponding Chinese Patent Application No. 201780093796.1 dated Aug. 25, 2021 (11 pages) (English translation included).

First Office Action from corresponding Chinese Patent Application No. 201880090530.6 dated Jun. 3, 2021 (13 pages) (English translation included).

International Search Report of International Application No. PCT/EP2018/085712, mailed Jul. 25, 2019, 2 pages.

Written Opinion of International Application No. PCT/EP2018/085712, mailed Jul. 25, 2019, 6 pages.

International Search Report of International Application No. PCT/EP2018/060995, mailed Jan. 17, 2019, 3 pages.

Office Action from corresponding Chinese Patent Application No. 201780093796.1, dated Jan. 27, 2021 (14 pages) (English translation included).

(56) References Cited

OTHER PUBLICATIONS

Nike Addresses Joyride Comparisons to Puma's Jamming Tech, SoleCollector.com, by Riley Jones, Aug. 7, 2019, 4 pages, [online], [site visited Sep. 4, 2019]. <URL: https://solecollector.com/news/2019/08/nike-addresses-joyride-comprisons-puma-jamming> (Year: 2019).

Nike Unveils Joyride Running Shoes in Latest Cushioning Experiment, SI.com, by Chris Chavez, Jul. 25, 2019, 5 pages, [online], [site visited Sep. 4, 2019].<URL: https://www.si.com/edge/2019/07/25/nike-jpyride-technology-sushioning-beaded-tpe-foam-rubber-details> (Year: 2019).

Puma Jamming—NRGY Beeds Shoe Review, YouTube.com, Tiffany Beers, Published on Jul. 21, 2018, 1 page, [online], [site visited Sep. 4, 2019]. <URL: https://www.youtube.com/watch?v=4ZS7NDY0RNc> (Year: 2018).

First Office Action with First Search issued in corresponding Chinese Application No. 201580085133.6, mailed Apr. 13, 2020, 15 pages.

International Search Report for PCT/EP2017/000972, mailed Oct. 25, 2017.

Notice of Reasons of Refusal issued in corresponding Japanese Application No. 2018-526089, dated Jun. 30, 2020, 11 pages.

* cited by examiner

SHOE, IN PARTICULAR SPORTS SHOE, AND METHOD FOR PRODUCING SAME

This application is a U.S. National Stage application, filed pursuant to 35 U.S.C. § 371, of international application no. PCT/EP2018/085712, filed on Dec. 18, 2018, the contents of which is incorporated herein by reference in its entirety.

The invention relates to a shoe, in particular to a sports shoe, having a shoe upper and a sole part connected to the shoe upper, wherein the sole part comprises a sole body having a bottom region and a side wall region, wherein the bottom region and the wall region form a receiving chamber which is open at the top, wherein the receiving chamber is filled with a bulk material, wherein the bulk material consists at least partially, preferably completely, of a thermoplastic elastomer (TPE), wherein the filled receiving chamber is sealed by a closure body and wherein the closure body is a knitted fabric that forms a lattice structure. The invention further relates to a method for producing such a shoe.

A shoe of the generic type is known from US 2016/0007675 A1. Similar solutions are shown in US 2009/0313853 A1 and U.S. Pat. No. 5,617,650 A.

A shoe of a similar kind is known from WO 2017/097315 A1. Foamed plastic balls are arranged in a sole element which has a cavity and are held in the cavity by a closure element. The sole produced in this way is connected to the upper part of the shoe. In the present case, the closure element is formed by a film which allows the wearer's foot to feel loose plastic balls located in the cavity.

However, it has been found with this solution that sometimes the wearing comfort of the shoe is negatively affected with this type of closure element.

The invention is therefore based on the object of developing a shoe of the type described above in such a way that a further improvement in wearing comfort can be achieved. At the same time, an economical process for manufacturing the shoe is to be provided.

The solution of this object by the invention is characterized in that the lattice structure has a mesh width of at least 0.75 and at most 2.0 mm, wherein bodies of spherical or ellipsoidal shape are used as bulk material, wherein the dimensions of the bodies of the bulk material in the three spatial directions are between 3 mm and 6 mm, wherein the closure body is provided with a reinforcing layer in its edge region, wherein the reinforcing layer runs around the entire circumferential area of the closure body, and wherein a reinforcing plate is arranged in the bottom region of the sole body. The mesh width of the lattice structure of the closure body is thereby preferably largely constant over the extension of the closure body.

Thus, in contrast to the previously known solution, no foil or classical textile material is used to close the cavity in the sole body and to retain the particles of the bulk material located in it, but a grid structure is used, the mesh width of which does not fall below a minimum value (and also does not exceed a maximum value).

It has been found that a particularly comfortable wearing sensation can be achieved in this way with a generic design of the shoe with loosely arranged particles, in particular of foamed plastic balls.

The closure body is preferably designed as a flat fabric structure. A woven structure in the form of a Leno weave has proved particularly effective in this respect. In such a Leno fabric, a plurality of weft threads is provided which extend in a longitudinal direction; a plurality of warp threads extends perpendicularly thereto. The warp threads are wound around the weft threads to provide high strength to the fabric.

Preferably, the fabric structure is formed by a fiber-reinforced thread.

An air- and moisture-permeable membrane may be arranged above and/or below the closure body. In this context, it should be mentioned that here, as well as throughout the present description, the orientation "below" and "above" refers to a shoe when it stands with its sole on the ground.

The closure body may be directly or indirectly glued and/or sewn to the sole body.

A reinforcing plate is arranged according to the invention in the bottom area of the sole body. The reinforcing plate forms a cover layer that reinforces the sole structure and prevents sink marks.

The shoe upper may be glued and/or sewn to the sole part.

The shoe upper preferably has an upper portion that is stitched to a strobel sole at the bottom.

The above mentioned reinforcing layer can be formed by a glued-on film. It preferably runs around the entire circumferential area of the closure body as an edge seam with a width of between 0.5 cm and 2.5 cm.

The bodies of the bulk material can also be formed as hollow bodies. It is provided that the mesh width of the lattice structure is smaller than the dimensions of the bodies of the bulk material.

The bodies of the bulk material preferably consist of foamed thermoplastic elastomer. In particular, thermoplastic polyurethane (TPU), thermoplastic polyamide (TPA) and/or olefin-based thermoplastic elastomer (TPO) are considered here, with the said materials being expanded (foamed) in particular.

A further very preferred embodiment of the invention provides that a circumferential frame is arranged in the upper end region of the wall region of the sole body, which frame is connected, in particular glued, to the sole body, wherein the frame having a bearing surface for the closure body and in particular its edge region. With such a design, it can be achieved that the closure body can be stably connected to the other sole element and has a defined bearing surface in the edge region.

The proposed method for manufacturing such a shoe comprises the steps:

a) manufacturing a shoe upper;

b) producing a sole part, wherein the production of the sole part comprising the steps:

b1) providing a sole body having a bottom region and a lateral wall region, wherein said bottom region and said wall region forming an open-topped receiving chamber;

b2) filling the receiving chamber with a bulk material, wherein the bulk material consisting at least partially, preferably completely, of a thermoplastic elastomer (TPE), wherein bodies of spherical or ellipsoidal shape are used as bulk material, wherein the dimensions of the bodies of the bulk material in the three spatial directions are between 3 mm and 6 mm;

b3) closing the filled receiving chamber with a closure body, wherein the closure body used being a knitted fabric which forms a lattice structure, wherein the lattice structure having a mesh width between 0.75 mm and 2.0 mm, wherein the closure body is provided with a reinforcing layer in its edge region, wherein the reinforcing layer runs around the entire circumferential area of the closure body, and wherein a reinforcing plate is arranged in the bottom region of the sole body;

c) fastening the shoe upper to the sole part so that the lower region of the shoe upper comes to rest on the closure body.

The production of the shoe in question is thus simplified and possible in an economical manner. All the above-mentioned embodiments can also be used in the above-mentioned process.

Due to the lattice structure of the closure body used, a stable manufacturing process can be achieved that reliably retains the particles of the bulk material in the cavity of the sole element.

When using the shoe, there is an improved wearing sensation, which is not achievable with the previously known solution.

Various possibilities are generally given for the production of the upper part of the shoe. In particular, it can be provided that the upper part of the shoe upper is produced in a classical manner, wherein the lower region, which extends below the sole of the foot of the wearer of the shoe, is, for example, a strobel sole (as explained above), which is sewn to the upper part of the shoe upper, for example. This can be done, in particular, in combination with a knitted upper portion of the shoe upper.

The sole part is preferably manufactured as an injection molded part or as a thermoformed part.

It can also be provided that at least one web-like structure is formed on the bottom area, which extends into the receiving space. This web-like structure forms wall areas within the receiving space which counteract the free displacement of the loosely filled bulk material and hold it in certain areas of the receiving space. This can have a positive effect on the walking experience when wearing the shoe.

The aforementioned web-like structure allows the sole to optimally support the foot in certain applications when used under load as intended. This can be relevant from the point of view that otherwise the (plastic) bodies located inside the receiving space of the sole part do not provide a great support function for the foot as a result of the fact that they are not connected to each other but are loosely arranged.

The plastic bodies preferably have a hardness between 75 and 90 Shore A, preferably between 80 and 85 Shore A. They preferably have a bulk density between 100 and 300 $kg/m^3$.

The following should be mentioned with regard to the expanded thermoplastic polyurethane (E-TPU) that is preferably used for the plastic bodies that are introduced into the receiving space of the sole part: This material is known per se and is used in shoes. It is available, for example, under the name "PEARLFOAM™," or E-TPU, from Columbia Sportswear North America, Inc., or under the name "INFINERGY™," or E-TPU, from BASF SE. Regarding this material, explicit reference is made to WO 2005/066250 A1, where details on this material, i.e. expandable thermoplastic polyurethanes and their production, can be found.

With regard to the prior art of urethane-based thermoplastic elastomer, explicit reference is also made to WO 2010/010010 A1, in which an expandable, blowing agent-containing thermoplastic polymer blend containing thermoplastic polyurethane and styrene polymer is disclosed. The polymer blend may contain at least one further thermoplastic polymer. In particular, polyamide (PA), polymethyl methacrylate (PMMA), polycarbonate (PC), polyethylene (PE), polypropylene (PP), polyvinyl chloride (PVC), cellulose or polyoxymethylene (POM) can be used as a further thermoplastic polymer.

The sole part is preferably made of thermoplastic polyurethane (TPU), thermoplastic elastomer (TPE), polyamide (PA) and/or rubber material.

Having spoken of bulk material in connection with the bodies to be placed in the receiving space, this refers to individual particles which have no connection to one another. In particular, according to a preferred embodiment of the invention, the plastic bodies are placed in the receiving space of the sole part without connection to each other. Accordingly, the individual spheres or ellipsoids are not connected to one another by any means, but are placed loosely in the receiving space of the sole part.

The bulk material is preferably placed in the receiving space of the sole section in full packing and preferably under slight pressure.

The mentioned sole part can still be provided with an outer sole on the underside if required.

It has been shown that when a shoe, in particular a sports shoe, is designed in the manner specified above with regard to the compression behavior of the shoe and its recovery properties (after removal of the compressive force by the wearer's foot), very advantageous and comfortable wearing properties of the shoe can be achieved. This applies in particular to the aspect of strong temperature fluctuations.

If the proposed thermoplastic elastomers (in contrast to conventional polymers) are used as loose bulk material in the cavity of the sole, favorable conditions result due to the frictional properties between the individual particles, since they do not slide along each other in an undesirable manner but, despite being loosely arranged, provide a certain amount of strength when the wearer's foot deforms the bulk material. Thus, an optimal compromise is achieved between a certain massaging effect on the one hand and a sufficient hold of the foot during the use of the shoe on the other hand.

In the drawings embodiments of the invention are shown.

Figure 2:
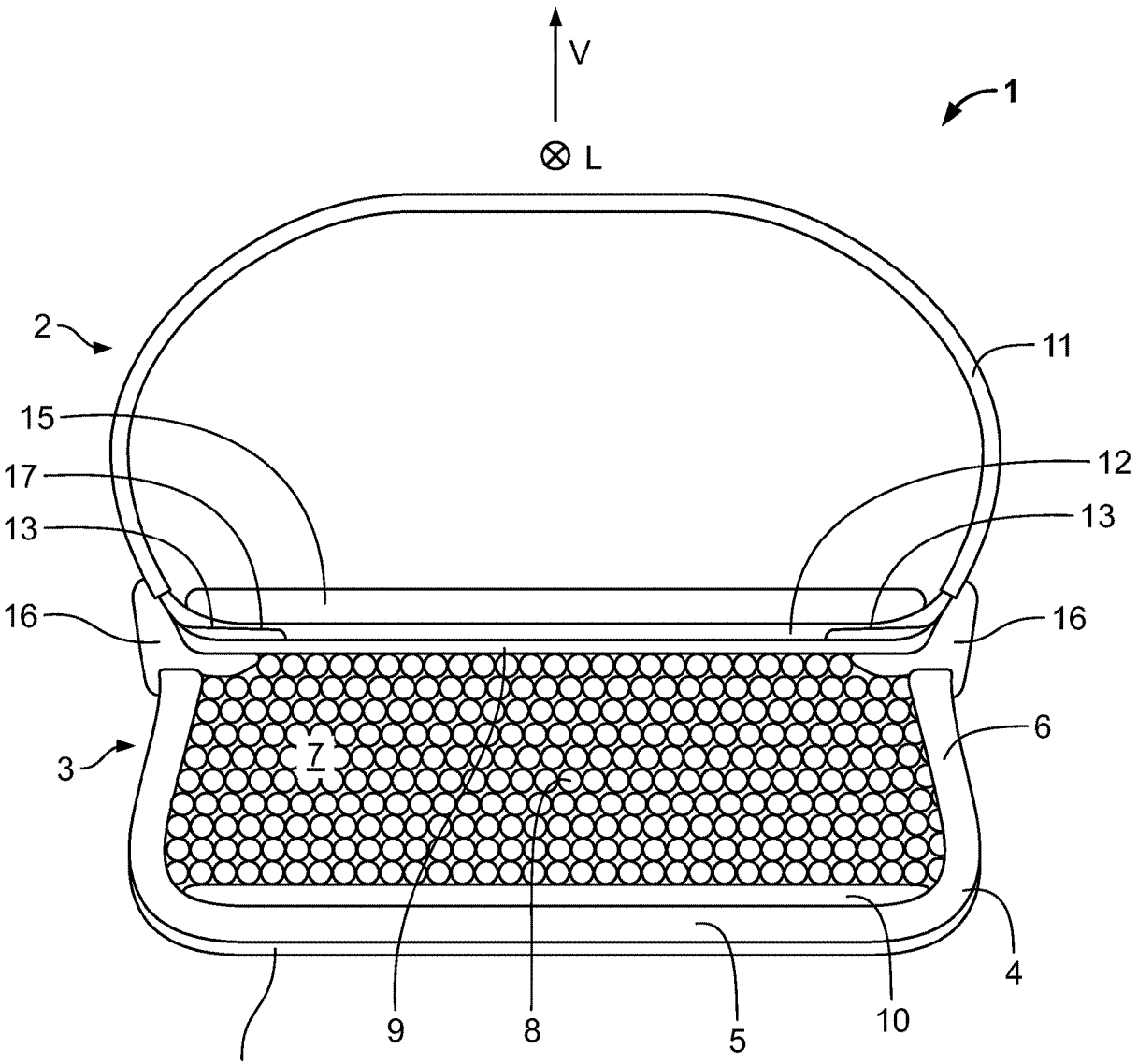

FIG. 1 in exploded view a sports shoe according to a first embodiment of the invention and FIG. 2 in a section perpendicular to the longitudinal direction of the shoe, a sports shoe according to a second embodiment of the invention.

In FIG. 1, a shoe 1 can be seen which has a shoe upper 2 and a sole part 3 which are connected to each other (which cannot be seen in FIG. 1 due to the exploded view). The designations "top" and "bottom" refer to the intended use of the shoe and when it is standing on the ground, respectively. The direction of the vertical V and the longitudinal direction L of the shoe 1 are shown.

The sole part 3 has a sole body 4, which has a bottom region 5 and a wall region 6 with a circumferential edge, so that the bottom region and the wall region delimit a receiving chamber 7, which is designed and provided for receiving bulk material 8. The sole body 4 can be manufactured, for example, by an injection molding process or by a thermoforming process.

After the shoe upper 2 and the sole part 3 have been produced (which can be done simultaneously or in any order), the receiving chamber 7 is filled with bulk material 8, which is only indicated in FIG. 1.

As can be seen from FIG. 2, the bulk material 8 is introduced into the receiving chamber 7 in complete packing and, if necessary, under slight pressure. Then the receiving chamber 7 is closed by fitting a closure body 9 so that the bulk material 8 is fixed in the receiving chamber 7.

It is essential that the closure body 9 is a knitted fabric which forms a lattice structure, the lattice structure having a mesh width $w_1$, $w_2$ (see FIG. 1) of at least 0.5 mm. The mesh width $w_1$ is the distance between the individual threads of the lattice structure in the longitudinal direction L, and the mesh width $w_2$ is the distance perpendicular thereto. The mesh widths $w_1$ and $w_2$ can be the same, but do not have to be. It is essential that the stated value of at least 0.5 mm is maintained, which is essential for improved wearing comfort.

The shoe upper 2 is then placed on the sole part 3 prepared in this way and the sole part 3 is joined to the shoe upper 2. This can be done by sewing and/or gluing.

Accordingly, the lower area of the shoe upper 2 now rests—via the closure body 9—on the bulk material 8, so that a pleasant walking sensation is created when using the shoe.

In general, any material can be used as bulk material 8 (e.g. also sand), while spheres or ellipsoids made of foamed plastic material are preferred; details are given above.

FIG. 2 shows a similar embodiment of the invention.

First of all, a reinforcing plate 10 should be mentioned here, which is placed in the bottom region 5 of the sole body 4 in order to give the sole improved rigidity. The reinforcing plate 10 can also be one with spring-elastic properties to support the running movement.

In the upper section 11 of the shoe upper 2, this is made of a material (woven or knitted material) which is connected at the bottom to a strobel sole 12; in FIG. 2, a seam is schematically indicated between the section 11 and the strobel sole 12.

A special design of the closure body 9 (lattice structure) is also particularly worthy of mention: This has a reinforcing layer 13 in a circumferential edge region, which is implemented by an applied film. The film can be glued on or bonded to the closure body 9 by a thermal process. A frame 16 is attached to the upper end of the wall region 6 of the sole body 4, which is designed as an oval annular structure and corresponds to the shape of the upper edge of the wall region 6. The frame 16 is connected, for example glued, to the upper end of the wall region 6. In this case, the frame 16 has a bearing surface 17 on which the closure body 9 rests with its edge. Here, the closure body 9 is glued to the frame 16 or fastened in some other way. The frame 16 at least partially envelops the upper end of the side wall region 6 of the sole body 4.

In the embodiment according to FIG. 2, the sole part 3 also comprises an outer sole 14; an insole 15 is inserted into the interior of the shoe upper 2.

By selecting the material-specific and geometric parameters (dimensions of the particles of the bulk material, size of the mesh, dimensions of the individual areas of the shoe upper and the sole part, choice of material, etc.), it is possible to influence the spring and damping behavior of the shoe and, in particular, of the sole.

While, as shown above, a loose insertion of individual bodies in the form of bulk material is envisaged, it is also possible in principle for said bodies made of said materials also to be coupled or joined together at least in part. In this respect, it is possible to create a structure in which a number of bodies are joined together, for example by microwave welding.

A similar composite of individual bodies can also be produced by embedding the individual bodies in a synthetic foam, in particular polyurethane foam, to create a structure that can be used to build the shoe sole.

REFERENCE NUMERALS

1 Shoe
2 Shoe upper
3 Sole part
4 Sole body
5 Bottom region of the sole body
6 Wall region of the sole body
7 Receiving chamber
8 Bulk material
9 Closure body
10 Reinforcing plate
11 Upper section of the shoe upper
12 Strobel sole
13 Reinforcing layer
14 Outer sole
15 Insole
16 Frame
17 Bearing surface
$w_1$ Mesh width
$w_2$ Mesh width
L Longitudinal direction of the shoe
V Vertical direction

The invention claimed is:

1. A shoe having a shoe upper and a sole part connected to the shoe upper, wherein the sole part comprises a sole body having a bottom region and a side wall region, wherein the bottom region and the side wall region form a receiving chamber which is open at a top, wherein the receiving chamber is filled with a bulk material, wherein the bulk material consists at least partially of a thermoplastic elastomer (TPE), wherein the receiving chamber is sealed by a closure body, and wherein the closure body is a fabric that forms a lattice structure, wherein the lattice structure of the closure body has a mesh width (w1, w2) of at least 0.75 mm and at most 2.0 mm, wherein bodies of spherical or ellipsoidal shape are used as bulk material, wherein dimensions of all of the bodies of the bulk material in three spatial directions are between 3 mm and 6 mm, wherein the closure body is provided with a reinforcing layer in its edge region, wherein the reinforcing layer runs around an entire circumferential area of the closure body, and wherein a reinforcing plate is arranged in the bottom region of the sole body, and wherein a frame is arranged in an upper end region of the side wall region of the sole body, the frame being connected to the sole body, wherein the frame has a bearing surface for the closure body and the frame is in direct contact with the bulk material, and wherein the frame envelops an upper end of the side wall region of the sole body.

2. The shoe according to claim 1, wherein the mesh width ($w_1$, $w_2$) of the lattice structure of the closure body is at least partially constant over an entire length of the closure body.

3. The shoe according to claim 1, wherein the closure body comprises a flat fabric structure.

4. The shoe according to claim 3, wherein the flat fabric structure is a Leno fabric.

5. The shoe according to claim 1, wherein a fiber-reinforced thread forms the lattice structure.

6. The shoe according to claim 1, wherein the closure body is directly or indirectly glued or sewn to the sole body.

7. The shoe according to claim 1, wherein the shoe upper is glued or sewn to the sole part.

8. The shoe according to claim 1, wherein the shoe upper has an upper section which is sewn at a bottom of the shoe with a strobel sole.

9. The shoe according to claim 1, wherein the reinforcing layer is formed by a glued-on film.

10. The shoe according to claim 1, wherein the bodies of the bulk material comprise hollow bodies.

11. The shoe according to claim 1, wherein the bodies of the bulk material consist of foamed thermoplastic elastomer.

12. The shoe according to claim 1, wherein the bodies of the bulk material are selected from a group consisting of: thermoplastic polyurethane (TPU), thermoplastic polyamide (TPA) and olefin-based thermoplastic elastomer (TPO), wherein said materials are expanded.

13. A method of manufacturing a shoe comprising the steps:

a) manufacturing a shoe upper;

b) producing a sole part comprising the steps:

b1) providing a sole body having a bottom region and a side wall region, wherein said bottom region and said side wall region forming a receiving chamber;

b2) filling the receiving chamber with a bulk material wherein the bulk material consisting at least partially of a thermoplastic elastomer (TPE), wherein bodies of spherical or ellipsoidal shape are used as bulk material, wherein dimensions of all of the bodies of the bulk material in three spatial directions are between 3 mm and 6 mm;

b3) closing the receiving chamber with a closure body, wherein the closure body is a fabric which forms a lattice structure, wherein the lattice structure having a mesh width (w1, w2) between 0.75 mm and 2.0 mm, wherein the closure body is provided with a reinforcing layer in its edge region, wherein the reinforcing layer runs around an entire circumferential area of the closure body, wherein a reinforcing plate is arranged in the bottom region of the sole body, wherein a frame is arranged in an upper end region of the side wall region of the sole body, the frame being connected to the sole body, wherein the frame has a bearing surface for the closure body and the frame is in direct contact with the bulk material, and wherein the frame envelops an upper end of the side wall region of the sole body; and c) fastening the shoe upper to the sole part so that the lower region of the shoe upper comes to rest on the closure body.

* * * * *